US005994986A

United States Patent [19]

Takahashi

[11] Patent Number: 5,994,986

[45] Date of Patent: Nov. 30, 1999

[54] HIGH FREQUENCY RELAY

[75] Inventor: Masaji Takahashi, Tokyo, Japan

[73] Assignee: NEC Corporation, Japan

[21] Appl. No.: 09/031,106

[22] Filed: Feb. 26, 1998

[30] Foreign Application Priority Data

Feb. 27, 1997 [JP] Japan ..... 9-044031

[51] Int. Cl.[6] ..... H01H 51/22

[52] U.S. Cl. ..... 335/78; 335/80; 335/81; 335/83; 335/128

[58] Field of Search ..... 335/78–86, 128; 200/305

[56] References Cited

U.S. PATENT DOCUMENTS

| | | | |
|---|---|---|---|
| 5,398,011 | 3/1995 | Kimura et al. | 335/79 |
| 5,475,353 | 12/1995 | Roshen et al. | 335/78 |
| 5,557,132 | 9/1996 | Takahashi | 257/415 |
| 5,652,559 | 7/1997 | Saia et al. | 335/78 |
| 5,673,011 | 9/1997 | Okihara et al. | 335/78 |
| 5,673,012 | 9/1997 | Stadler et al. | 335/78 |
| 5,734,308 | 3/1998 | Dittmann et al. | 335/78 |

FOREIGN PATENT DOCUMENTS

| | | |
|---|---|---|
| 6-12957 | 1/1994 | Japan . |
| 612957 | 1/1994 | Japan . |
| 714489 | 1/1995 | Japan . |
| 7-211212 | 8/1995 | Japan . |
| 7211212 | 8/1995 | Japan . |

OTHER PUBLICATIONS

Kuzukawa et al; "High Frequency Relays of Micro–strip–line or Coplanar–wave–guide construction"; 1997; pp. 6–1–6–8; Proc. 45th Relay Conference, 1997 (Apr. 21–Apr. 23, 1997).

*Primary Examiner*—Lincoln Donovan
*Assistant Examiner*—Tuyen Nguyen
*Attorney, Agent, or Firm*—Hayes, Soloway, Hennessey, Grossman & Hage, P.C.

[57] ABSTRACT

A high frequency relay for switching a high frequency signal includes stationary contacts and terminals formed on a substrate in a planar configuration. An upper and a lower ground layer are respectively formed on the upper and lower surfaces of the substrate in the vicinity of the stationary contacts and terminals. A movable contact spring is so configured as to be connected to ground via the ground layers when it opens the contacts. With this configuration, the relay is capable of reducing the leakage of signals and thereby enhancing isolation characteristic.

8 Claims, 7 Drawing Sheets

HIGH FREQUENCY RELAY

BACKGROUND OF THE INVENTION

The present invention relates to a high frequency relay and, more particularly, to a high frequency relay for switching high frequency signals.

A prerequisite of a high frequency relay is that signals be prevented from leaking between contacts and terminals. To meet this prerequisite, the length of signal terminals may be reduced. For example, stationary contacts and stationary contact terminals may be formed on a substrate in a planar configuration, and the terminals may be led to the underside of the substrate. Such terminals will be soldered to connection terminals provided on a mounting circuit board, implementing leadless mounting. This kind of scheme is taught in, e.g., Japanese Patent Laid-Open Publication No. 7-211212. Signal leakage will also be reduced if the distance between contacts is increased, as disclosed in Japanese Patent Laid-Open Publication No. 7-14489. This can be done with two sets of contacts capable of selectively interrupting a signal path. Further, a conductor connected to ground may be located in the vicinity of contacts and terminals for a shielding purpose, as proposed in, e.g., Japanese Patent Laid-Open Publication No. 6-12957.

However, a problem with a conventional high frequency relays is that they cannot sufficiently reduce signal leakage between contacts, i.e., cannot implement sufficient isolation loss. Conventional relays each has movable contacts respectively located in the vicinity of two stationary contacts of each set in order to bridge them. In this configuration, coupling capacitance between the two stationary contacts increases and brings about signal leakage.

Technologies relating to the present invention are also disclosed in, e.g., K. Kuzukawa et al. "High Frequency Relays of Micro-strip-line or Coplanar-wave-guide Construction", Proc. 45th Relay Conference, pp. 6-1 through 6–8, 1997.

SUMMARY OF THE INVENTION

It is therefore an object of the present invention to provide a high frequency relay capable of reducing signal leakage and improving a isolation characteristics.

A high frequency relay of the present invention includes a substrate. At least a single pair of stationary contacts are formed on the upper surface of the substrate. A movable contact spring is driven by an armature included in an electromagnet. Movable contacts are affixed to the movable contact spring for selectively opening or closing the pair of stationary contacts. An upper and a lower ground layer are respectively formed on the upper and lower surfaces of the substrate and adjoin the pair of stationary contacts and a wiring connected to the stationary contacts. The movable contact spring contacts the upper ground layer to be thereby connected to ground when the pair of stationary contacts are opened, thereby shielding the pair of stationary contacts together with the upper and lower ground layers.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

To better understand the present invention, brief reference will be made to a conventional high frequency relay proposed in Laid-Open Publication No. 7-211212 mentioned earlier and constructed to reduce signal leakage between contacts and terminals. Briefly, the relay has stationary contacts and stationary contact terminals formed on a substrate in a planar configuration. The terminals are led to the underside of the substrate and soldered to connection terminals provided on a circuit board. This configuration reduces the length of signal terminals.

Figure 1:
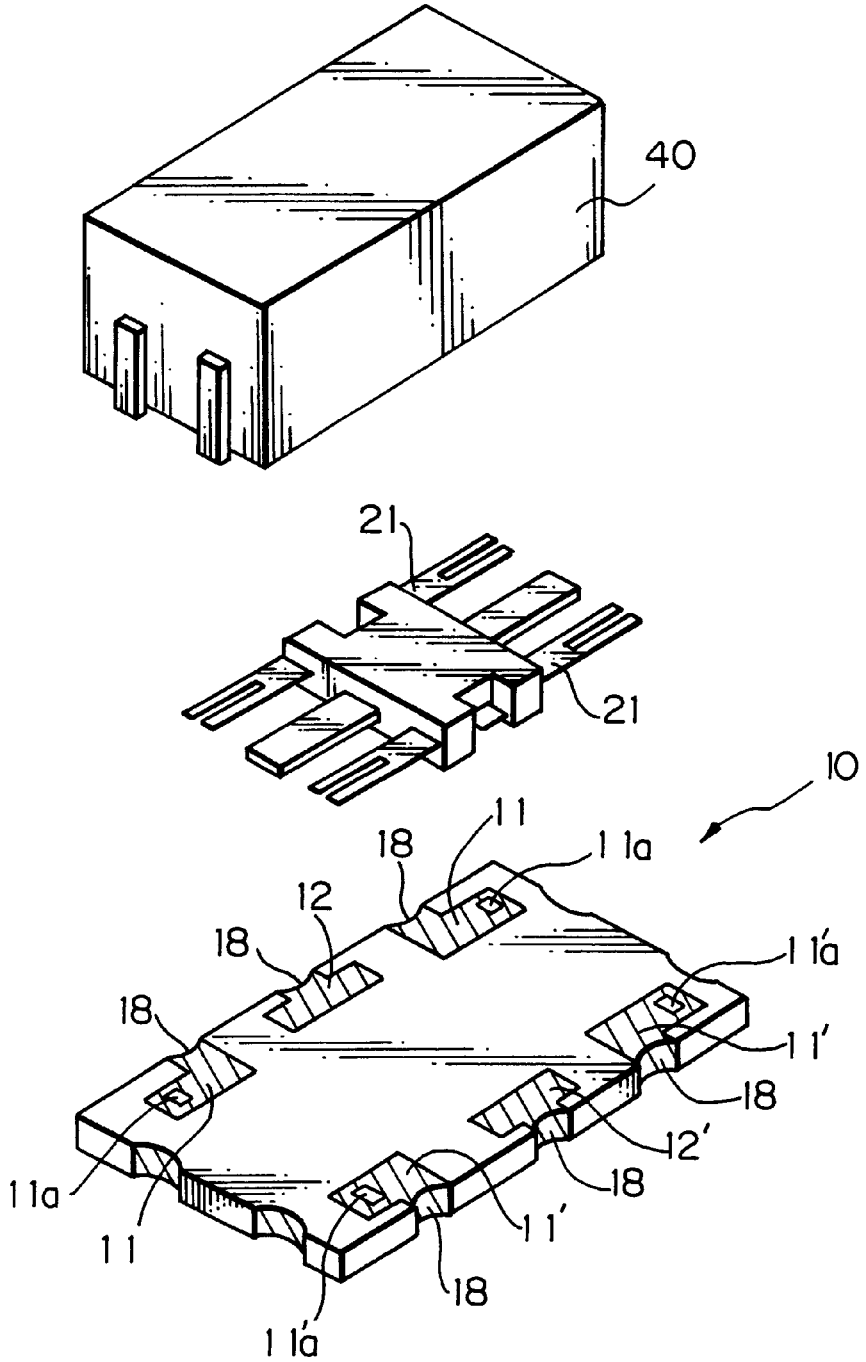
Fig. 1 PRIOR ART
FIG. 1 is an exploded perspective view showing a conventional high frequency relay.

Specifically, as shown in FIG. 1, the above relay includes a housing made up of a bottom-open box-like case 40 and a substrate 10 mounted on the bottom of the case 40. The substrate 10 is implemented by a printed circuit board. Formed on the substrate 10 are wiring patterns 11*a* and 11'*a* serving as stationary contacts, wiring patterns 11 and 11' serving as contact terminals, and wiring patterns 12 and 12' serving as connection terminals. The wiring patterns 12 and 12' are connected to a movable contact spring 21. The wiring patterns 11*a*, 11'*a*, 11, 11', 12 and 12' are respectively led to the underside of the substrate 10 via semicircular notches 18 formed in opposite side edges of the substrate 10, and are used as connection terminals for soldering. The substrate 10 is connected to a circuit board in a leadless configuration via the above wiring patterns.

Figure 2A:
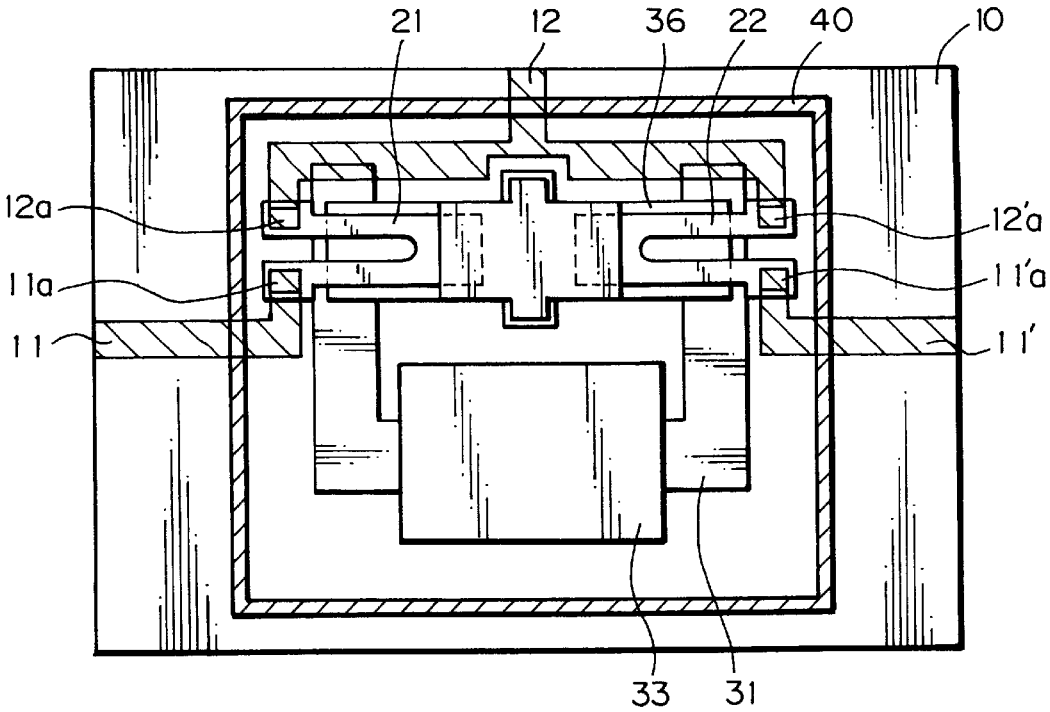
Fig. 2A PRIOR ART
FIGS. 2A and 2B are respectively a plan view and a section view showing another conventional high frequency relay.
Figure 2B:
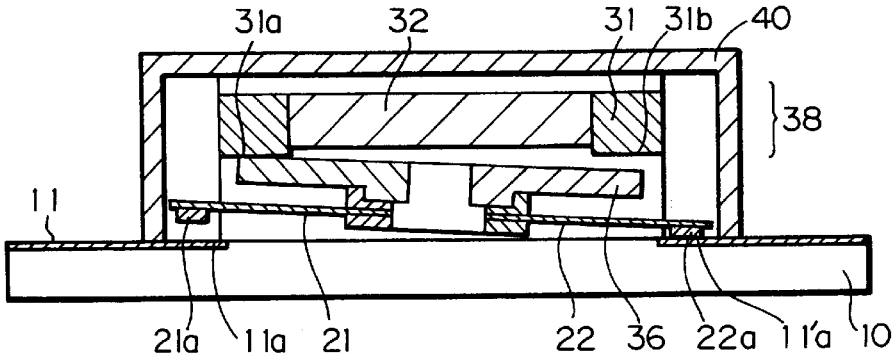
Fig. 2B PRIOR ART
Figure 2C:
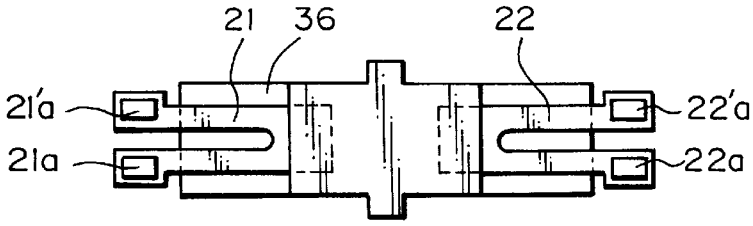
Fig. 2C PRIOR ART
FIG. 2C is a plan view of an armature block included in the relay shown in FIGS. 2A and 2B.

FIGS. 2A–2C show a high frequency relay taught in Laid-Open Publication No. 7-14489 also mentioned earlier and also configured to reduce signal leakage. Briefly, this relay increases the distance between contacts by interrupting a signal path with two sets of contacts. Specifically, as shown in FIG. 2, the relay includes a bottom-open box-like case 40. A polarized electromagnet 38 is made up of a generally U-shaped core 31, a coil 33 wound round the core 31, and a permanent magnet 32 extending between the two arms of the core 31. An armature 36 is movable in a see-saw fashion by being attracted by magnetic poles 31*a* and 31*b* formed on the core 31. Movable contact springs 21 and 22 are mounted on the armature 36 while being insulated from the armature 36. A substrate 10 in the form of a printed circuit board is mounted on the bottom of the case 40. Contact terminals 11, 11' and 12 and stationary contacts 11*a*, 11'*a*, 12*a* and 12'*a* are formed on the substrate 10. The movable contact springs 21 and 22 each is bifurcated to have two arms. Movable contacts 21*a* and 21'*a* and movable contacts 22*a* and 22'*a* are respectively affixed to the ends of the arms of the springs 21 and 22, as illustrated. The movable contacts 21*a*, 21'*a*, 22 and 22'*a* are so positioned as to face the stationary contacts 11*a*,11'*a*, 12*a* and 12'*a*, respectively.

In operation, the armature 36 angularly moves in accordance with the direction of current flowing to the coil 33, causing the contact springs 21 and 22 to move therewith. As a result, the movable contacts 21*a* and 21'*a* on the contact spring 21 or the movable contacts 22*a* and 22'*a* on the contact spring 22 contact the stationary contacts 11*a* and 12*a* or the stationary contacts 11'*a* and 12'*a*.

Figure 3:
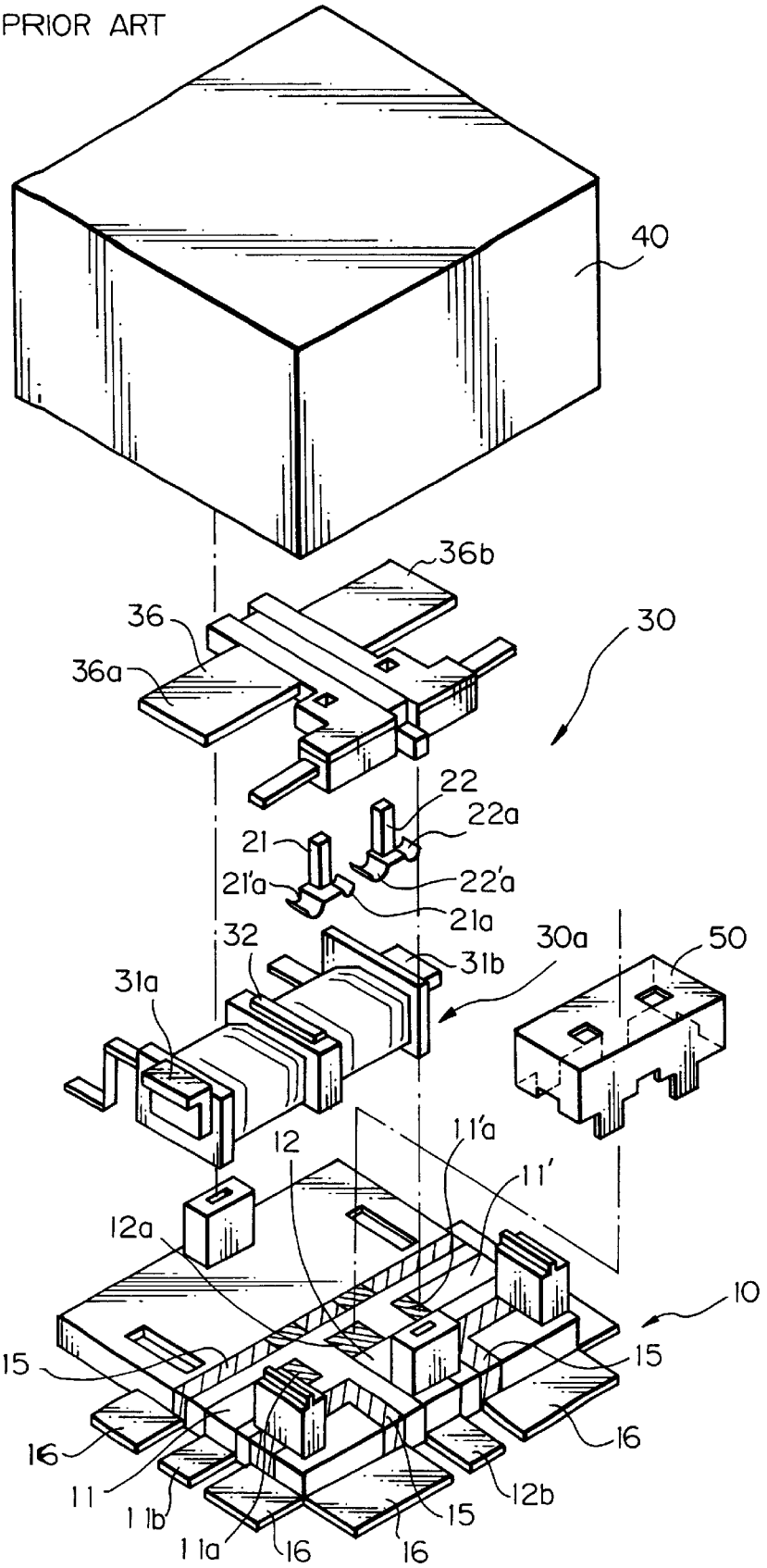
Fig. 3 PRIOR ART
FIG. 3 is an exploded perspective view showing still another conventional high frequency relay.

FIG. 3 shows a high frequency relay disclosed in Laid-Open Publication No. 6-12957 also mentioned earlier and directed toward the reduction of signal leakage. As shown, the relay includes a substrate 10 having stationary contact terminals 11, 11' and 12, stationary contacts 11*a*, 11'*a* and 12*a*, and ground terminals 15 and 16 molded together by the insertion molding of insulating resin. An electromagnet block 30 is positioned above the substrate 10 and causes an armature 36 to angularly move by exerting attraction thereon. Movable terminals 21 and 22 are affixed to the armature 36 while being insulated from the armature 36. Movable contacts 21*a* and 21'*a* and movable contacts 22*a* and 22'*a* are respectively affixed to the ends of the movable terminal 21 and the ends of the movable terminal 22. The movable contacts 21*a*, 21'*a*, 22*a* and 22'*a* face the stationary contacts 11*a*, 12*a* and 11'*a*. A shield box 50 is mounted on the substrate and connected to ground. The shield box 50 surrounds the above movable contacts, stationary contacts and terminals. When the electromagnet 30*a* is energized, it causes the armature 36 to angularly move in accordance with the direction of a current flowing through the electromagnet 30*a*. As a result, the movable contact terminals 21 and 22 move integrally with the armature 36. This causes the movable contacts 21*a* and 21'*a* or the movable contacts 22*a* and 22'*a* to contact the stationary contacts 11*a* and 12*a* or the stationary contacts 11'*a* and 12*a* associated therewith.

The conventional high frequency relays described above have a problem that they cannot sufficiently reduce signal leakage between the contacts, i.e., they cannot implement a sufficient isolation loss, as stated earlier.

Figure 4A:
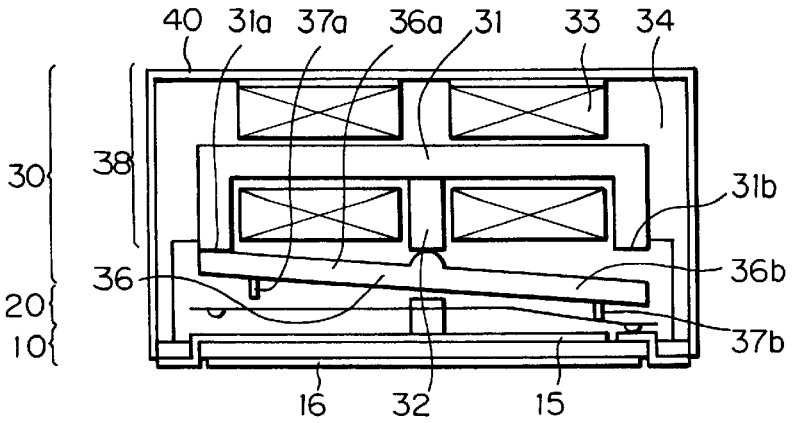
FIG. 4A is a section showing a high frequency relay embodying the present invention.
Figure 4B:
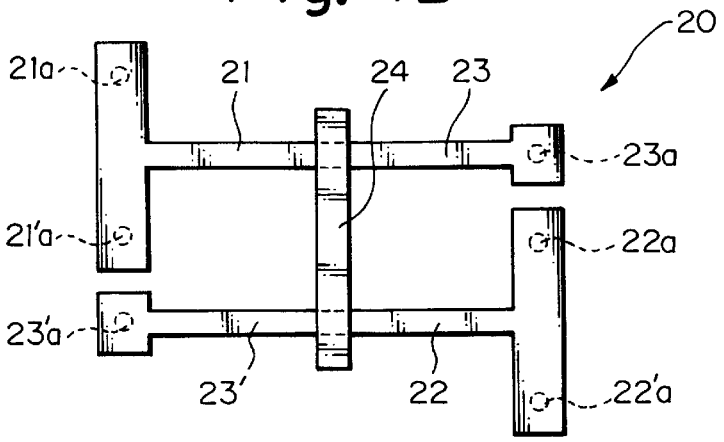
FIG. 4B is a plan view of a contact spring block included in the illustrative embodiment.
Figure 4C:
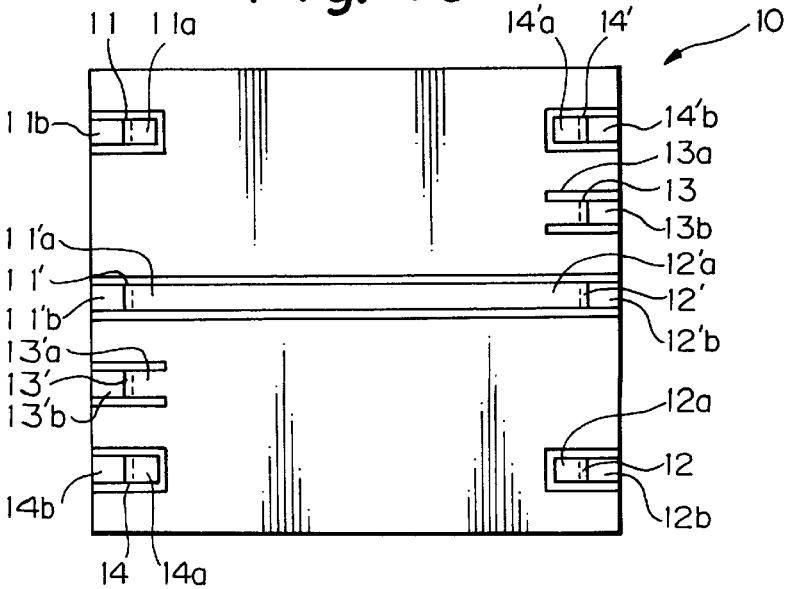
FIG. 4C is plan view of a substrate also included in the illustrative embodiment.

Referring to FIGS. 4A–4C, a high frequency relay embodying the present invention will be described. As shown, the relay is generally made up of a flat substrate 10, a contact spring block 20, an electromagnet block 30, and a case 40. Make contact terminals 11 and 11', break contact terminals 12 and 12', ground contact terminals 13 and 13', coil terminals 14 and 14' and an upper ground layer 15 are formed on the upper surface of the substrate 10 by stamping of a lead frame. Pads 11*b*–14'*b* for soldering and a lower ground layer 16 are formed on the lower surface of the substrate 10. The make contact terminal 11' and break contact terminal 12' are connected to each other. The ground contact terminals 13 and 13' are connected to the upper ground layer 15. On the upper surface of the substrate 10, stationary contacts 11*a*, 11'*a*, 12*a*, 12'*a*, 13*a*, 13'*a*, 14*a*and 14'*a* are respectively formed at one end of the terminals 11, 11', 12, 12', 13, 13', 14 and 14' by the plating of precious metal or by soldering of bulk precious metal. The terminals 11–14' are folded twice at the other ends thereof to form solder pads 11*b*–14'*b*, respectively. The pads 11*b*–14'*b* positioned on the bottom of the substrate 10 from leadless mounting. The lower ground layer 16 is formed by a stamped lead frame whose portions to overlap the solder pads. The substrate 10 is molded together with the terminals 11–14' and ground layers 15 and 16 by injection molding with an insulating resin. Alternatively, one may use a conventional two-sided printed circuit board having terminals on both sides thereof which are connected together by through holes, a two-sided printed ceramic substrate, or a tridimensional wiring circuit board formed by double molding a compound containing a plating catalyst and then plating the entire board.

The contact spring block 20 has four parallel springs, i.e., make contact spring 21, a brake contact spring 22 and ground contact springs 23 and 23' having their center portions connected together by a bridge 24. The make contact spring 21 and ground contact spring 23 are connected to each other at their fixed ends. Likewise, the movable contact spring 22 and ground contact spring 23' are connected to each other at their fixed ends. The make contact spring 21 and break contact spring 22 each has a generally T-shaped free end. Movable contacts 21*a* and 21'*a* and movable contacts 22*a* and 22'*a* are respectively formed on the free ends of the make contact spring 21 and break contact spring 22. Movable ground contacts 23*a* and 23'*a* are respectively formed on the free ends of the ground contact springs 23 and 23'. The bridge 24 is affixed to the upper surface of the substrate 10 such that the springs 21–23' extend parallel to the substrate 10. The make contacts 21*a* and 21'*a*, break contacts 22*a* and 22'*a* and ground contacts 23*a* and 23'*a* respectively face the stationary contacts 11*a*, 11'*a*, 12*a*, 12'*a*, 13*a* and 13'*a*. The make contacts 21*a* and 21'*a* of the make contact spring 21 and the ground contact 23'*a* of the ground contact spring 23' are positioned at one side of the bridge 24 and driven together. The break contacts 22*a* and 22'*a* of the break contact spring 22 and the ground contact 23*a* of the ground contact spring 23 are positioned at the other side of the bridge 24 and driven together alternately with the make contacts 21*a* and 21'*a* and ground contact 23'*a*.

In the above configuration, when the make contact spring 21 bridges the stationary make contacts 11*a* and 11'*a*, the movable ground contact 23'*a* of the ground contact spring 23' connected to the break contact spring 22 contacts the stationary ground contact 13'*a* of the substrate 10. As a result, the break contact spring 22 in its open state is connected to ground. Likewise, when the break contact spring 22 bridges the stationary break contacts 12*a* and 12'*a*, the ground contact 23*a* of the ground contact spring 23 is closed and connects the make contact spring 21 to ground.

The electromagnet block 30 includes an electromagnet 38 made up of a spool 34, a generally U-shaped core 31 molded integrally with the spool 34 by injection molding, a permanent magnet 32 mounted on substantially the center of the core 31, and a coil 33. A hinge spring is soldered to the intermediate portion of an armature 36 so as to allow it to move in a see-saw fashion. The armature 36 has two arms 36*a* and 36*b* respectively engageable with magnetic poles 31*a* and 31*b* formed on both ends of the core 31. Studs (or cards) 37*a* and 37*b* are respectively affixed to the free end portions of the arms 36*a* and 36*b* so as to press the contact springs 21 and 23' or contact springs 22 and 23 facing them. The substrate 10 is fitted in the bottom opening of the case 40 while the contact spring block 30 and electromagnetic block 30 are received in the case 40. The substrate 10 and case 40 are connected together by adhesive, so that the inside of the case 40 is hermetically sealed.

Figure 5A:
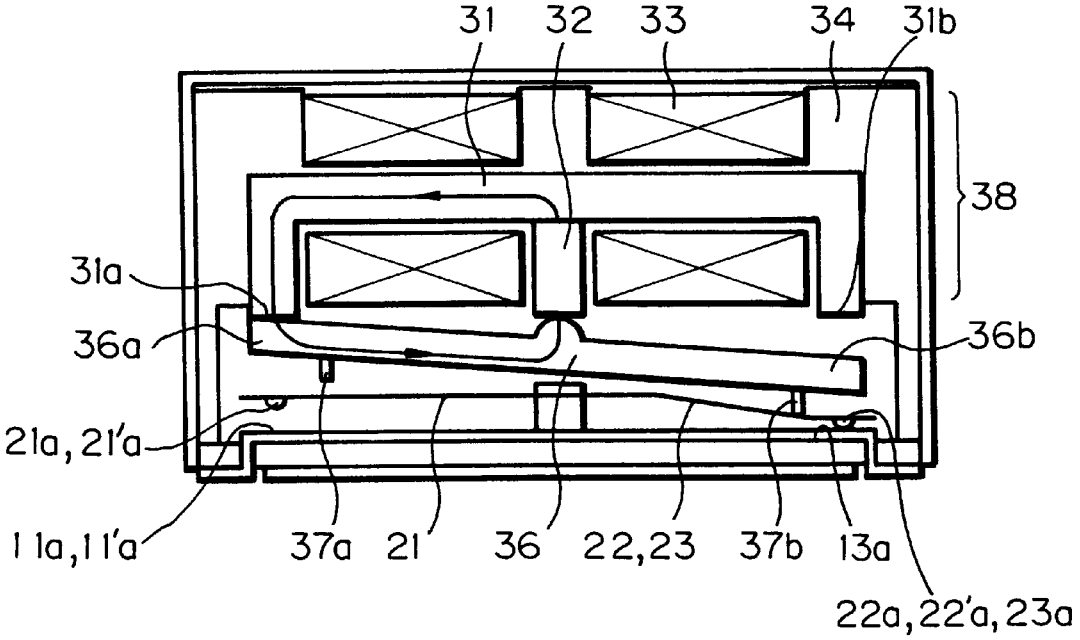
FIGS. 5A and 5B demonstrate the operation of the illustrative embodiment.
Figure 8:
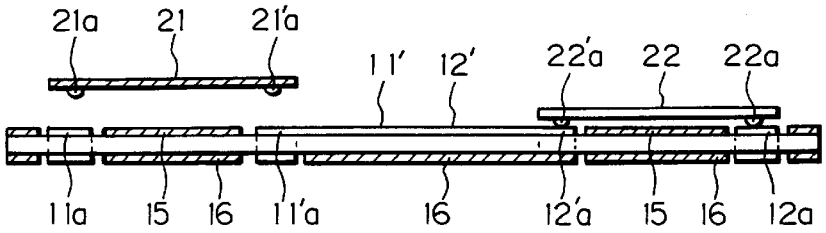
FIG. 8 is a sectional view showing the stationary contact shielded by ground layers.

The operation of the illustrative embodiment will be described with reference to FIGS. 5A and 5B. As shown in FIG. 5A, when the electromagnet 38 is not energized, one arm 36*a* of the armature 36 is held in contact with the pole 31*a* due to the force of the permanent magnet 32. The other arm 36*b* of the armature 36 presses the break contact spring 22 and ground contact spring 23 with the stud 37*b*. Consequently, the movable break contacts 22*a* and 22'*a* of the break contact spring 22 and the movable ground contact 23*a* of the ground contact spring 23 are closed. In this condition, as shown in FIG. 8, the make contact spring 21 positioned above the stationary make terminal 11*a* which is open is connected to ground. The stationary make terminal 11*a* is therefore shielded from stationary make terminal 11'*a* by the grounded make contact spring 21 and the upper and lower ground layers 15 and 16 of the substrate 10. As a result, signal leakage from the closed stationary break contacts 12*a* and 12'*a* and stationary make terminal 11'*a* connected thereto toward the open stationary make terminal 11*a* is sufficiently reduced.

Figure 5B:
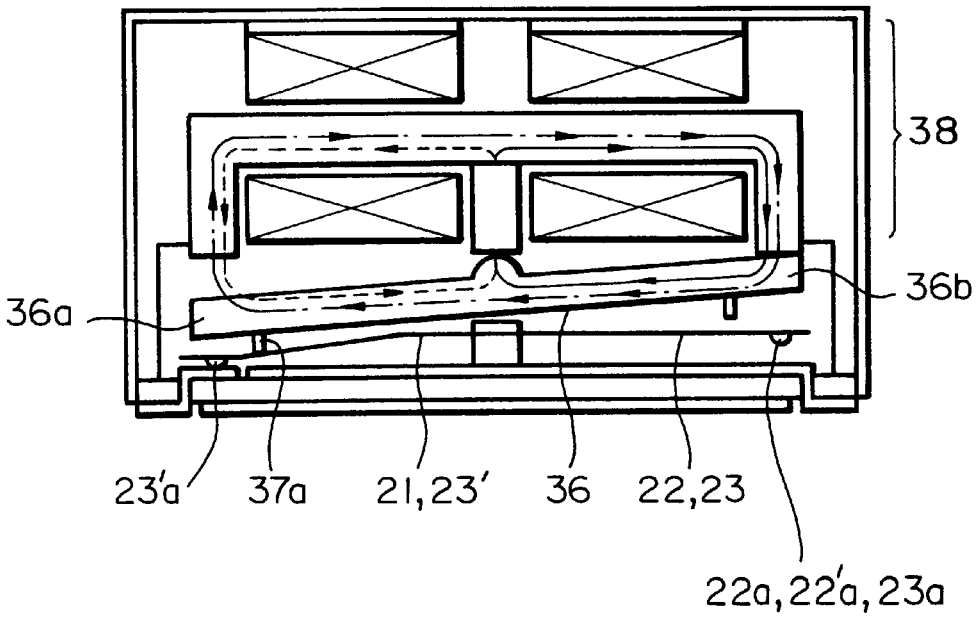

As shown in FIG. 5B, assume that the electromagnet 38 is energized in the direction in which the magnetic flux of the permanent magnet 32 flowing through the arm 36*a* is cancelled; the magnetic fluxes of the magnet 32 are indicated by a solid line and a dotted line. Then, the flux of the electromagnet 38 indicated by a dash-and-dot line and that of the permanent magnet 32 cooperate to attract the other arm 36*b* of the armature 36. As a result, the armature 36 turns reversely and opens the movable break contacts 22*a* and 22*a*' of the break contact spring 22 and the movable ground contact 23*a* of the ground contact spring 23. At the same time, the arm 36*a* presses the make contact spring 21 and ground contact spring 23' with the stud 37*a*, causing the movable break contacts 21*a* and 21'*a* and movable ground contact 23'*a* to close. Subsequently, when the electromagnet 38 is deenergized, the armature 36 again turns reversely despite the magnetic attraction torque of the permanent magnet 32 acting on the arm 36*b*. This is because the magnetic attraction torque is smaller than the sum of the restoration torques of the contact springs 21 and 23' and hinge spring. Consequently, the arm 36*a* is magnetically retained by the pole 31*a* while the break contacts 22*a* and 22'*a* and make contacts 21*a* and 21'*a* are again closed and opened, respectively.

Figure 6A:
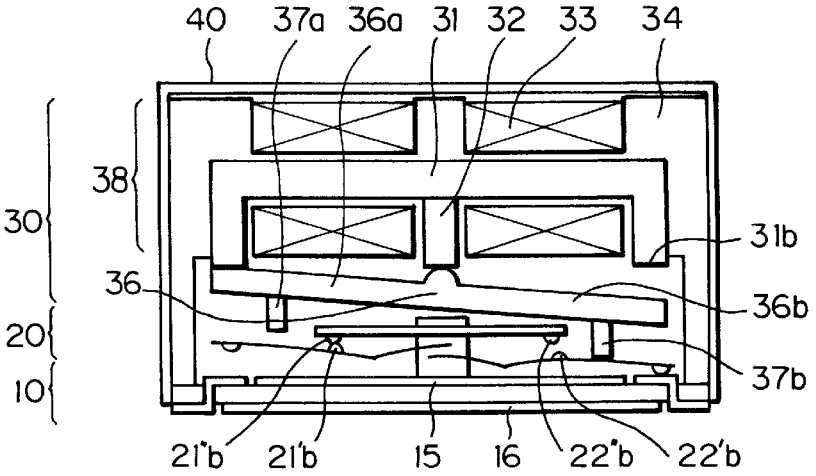
FIG. 6A is a section view showing an alternative embodiment of the present invention.
Figure 6B:
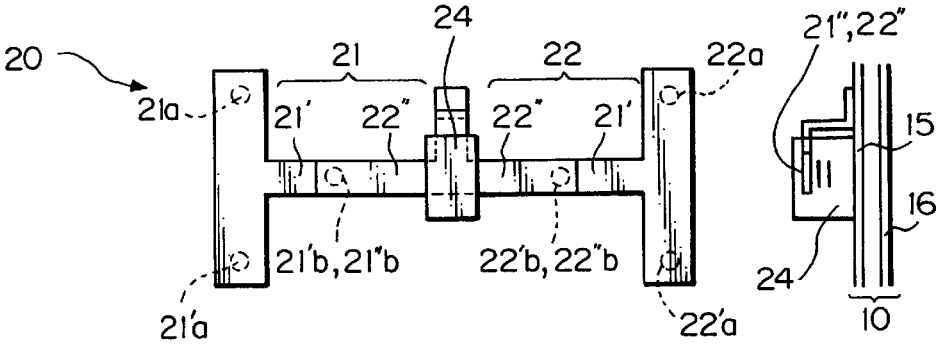
FIG. 6B shows in a plan view and a side elevational view of a contact spring block included in the alternative embodiment.
Figure 6C:
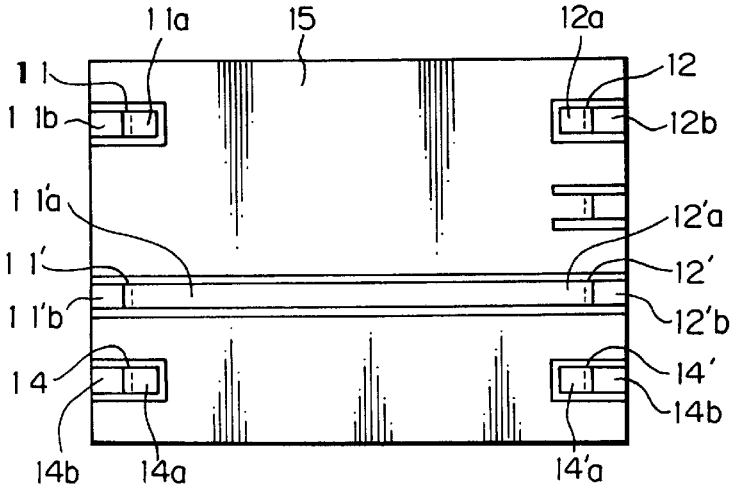
FIG. 6C is a plan view of a substrate also included in the alternative embodiment.

Reference will be made to FIGS. 6A–6C for describing an alternative embodiment of the present invention. In FIGS. 6A–6C, the same or similar structural elements as or to the elements shown in 4A–4C are designated by the same reference numerals. As shown, the contact spring block 20 included in this embodiment has a make contact spring 21 and a break contact spring 22 fixed in place by a center molding 24. The make contact spring 21 is made up of a first and a second spring 21' and 21". The first spring 21' has a generally T-shaped free end and includes movable make contacts 21*a* and 21'*a* for bridging the two stationary contacts 11*a* and 11'*a*. The second spring 21" is connected to the ground layer 15 by a relatively thick leaf spring and carries a stationary break contact 21"*b* on its free end. The spring 21' has a movable break contact 21'*b* contacting the stationary break contact 21"*b* of the spring 21" when the movable make contacts 21*a* and 21'*a* are open, but moving away from the contact 21"*b* when the contacts 21*a* and 21'*a* close. This is also true with the break contact spring 22. The make contact spring 21 and break contact spring 22 are positioned at opposite sides of the center mold 24. The springs 21' and 22' are respectively driven by the studs 37*a* and 37*b* of the armature 36 in the same manner as in the previous embodiment.

When the movable make contacts 21*a* and 21'*a* are open, the make contact spring 21 is connected to ground. When the movable break contacts 22*a* and 22'*a* are open, the break contact spring 22 is connected to ground. When the stationary make contact 11*a* is open, it is shielded by the movable contact spring 21 connected to ground together with the ground layers 15 and 16. This successfully reduces signal leakage from the stationary break contacts 12*a* and 12'*a* (common with the stationary make terminal 11'*a*) held in their closed positions toward the stationary make terminal 11*a*. This is also true with the stationary make contacts 11*a* and 11'*a*. This embodiment has an additional advantage that it reduces the area of the bottom of the substrate 10.

Figure 7A:
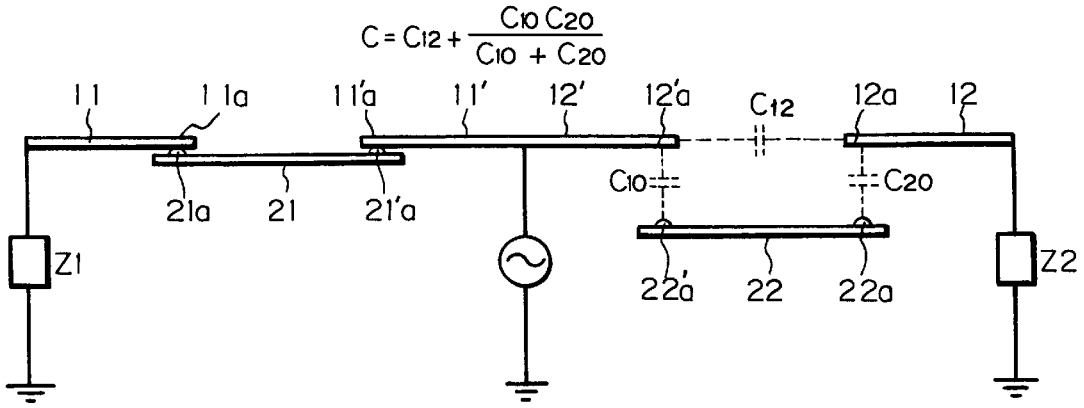
FIGS. 7A and 7B are circuit diagrams illustrating coupling capacitance between stationary contacts.
Figure 7B:
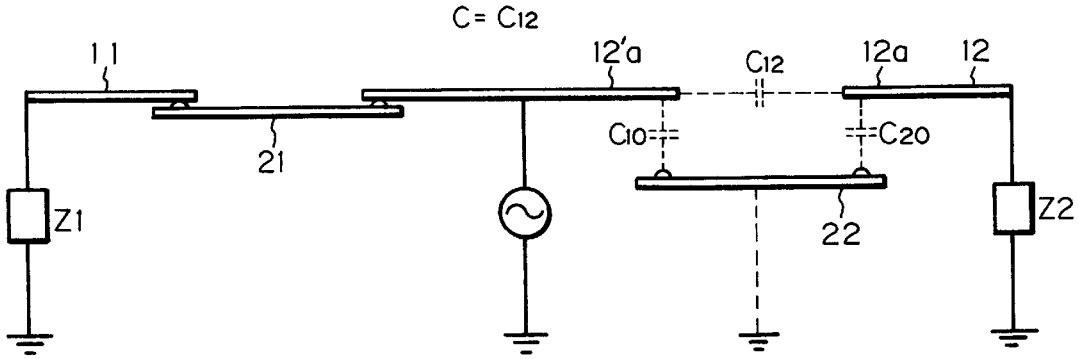

Now, as shown in FIG. 7A, assume that the movable contacts 22*a* and 22'*a* and spring 22 which are conductive are positioned in the vicinity of the two stationary contacts 12*a* and 12'*a*. Then, the coupling capacitance between the stationary contacts 12*a* and 12'*a* is the sum of a capacitance $C_{12}$ between them, a capacitance $C_{10}$ between the stationary contact 12'*a* and the conductors 22'*a* and 22, and a capacitance $C_{20}$ between the stationary contact 12*a* and the conductors 22*a* and 22. The coupling capacitance is therefore far greater than the capacitance $C_{12}$. As shown in FIG. 7B, when the conductors are connected to ground, an impedance $1/J\omega C_{20}$ ascribable to ground capacitance and a load impedance $Z_2$ are connected in parallel between the stationary contact 12*a* and ground. Because the earth capacitance $C_{20}$ is sufficiently small and because ground capacitance impedance $1/j\omega C_{20}$ is far greater than the load impedance $Z_2$, the impedance between the stationary contact 12*a* and ground is substantially equal to the load impedance $Z_2$. That is, the coupling capacitance between the stationary contacts 12*a* and 12'*a* consists only of the extremely small capacitance $C_{12}$, so that the capacitances $C_{10}$ and $C_{20}$ are related little. In this manner, by connecting the above conductors to ground, it is possible to reduce the coupling capacitance between the stationary contacts to a sufficient degree. Therefore, to reduce the coupling capacitance between the stationary contacts and therefore signal leakage, it is necessary that the movable contacts and movable contact springs be connected to ground when opened.

Conventional high frequency relays cannot sufficiently reduce signal leakage because their movable contact springs are not connected to ground when contacts are opened. By contrast, in accordance with the present invention, ground layers are provided on the upper and lower surfaces of a substrate in the vicinity of stationary contacts and contact terminals formed on the substrate. When movable contacts are opened, a contact spring is connected to the ground layers in order to shield the stationary contacts. This successfully reduces the coupling capacitance between the stationary contacts and therefore signal leakage.

Specifically, as shown in FIG. 8, the present invention includes the stationary contacts and stationary terminals arranged on the substrate in a planar configuration, and the upper and lower ground layers 15 and 16 formed on the substrate 10 and adjoining the above contacts and terminals. When the signal contacts are opened, the movable contact spring 21 or 22 associated therewith is connected to ground via the upper ground layer 15. As a result, when the contacts are opened, the stationary contacts of the signal circuit are enclosed by the movable contact springs 21 and 22 connected to ground together with the ground layers 15 and 16. This reduces the coupling capacitance between the contacts and thereby sufficiently reduces signal leakage ascribable to the coupling capacitance.

In summary, it will be seen that the present invention provides a high frequency relay achieving an improved performance, particularly an improved isolation ability. This advantage is derived from a unique arrangement wherein the relay is mounted by leadless mounting with its signal contacts shielded by contact springs and ground layers connected to ground, thereby reducing signal leakage via signal contacts and terminals. Further, the relay of the invention is miniature and easy to produce because the contacts are arranged in a planar configuration in order to eliminate the need for a shield box and ground terminals between signal terminals.

Various modifications will become possible for those skilled in the art after receiving the teachings of the present disclosure without departing from the scope thereof.

What is claimed is:

1. A high frequency relay comprising:

a substrate;

at least a single pair of stationary contacts formed on an upper surface of said substrate;

a movable contact spring driven by an armature fitted within an electromagnet, said movable contact spring comprising four spring elements including a make contact spring a brake contact spring, and first and second ground contact springs all connected to a common bridge; said make contact spring and said first ground contact spring being connected to one another at opposite sides of said bridge and said brake contact spring and said second ground contact spring being connected to one another at opposite sides of said bridge;

movable contacts affixed to said movable contact spring for selectively opening or closing said pair of stationary contacts; and upper and lower ground layers respectively formed on an upper and a lower surface of said substrate and adjoining said pair of stationary contacts and a wiring connected to said pair of stationary contacts;

said movable contact spring contacting said upper ground layer to be thereby connected to ground when said pair of stationary contacts are opened, thereby shielding said pair of stationary contacts together with said upper ground layer and said lower ground layer.

2. A relay as claimed in claim 1, wherein said movable contact spring is fixed in place at a center thereof and carries said movable contacts at one end thereof, a movable contact being carried on the other end of said movable contact spring and engageable with said upper ground layer, said movable contact on said other end contacting, when said movable contacts on said one end open said stationary contacts, said upper ground layer to thereby connect said movable contact spring to ground.

3. A relay as claimed in claim 1, wherein said movable contact spring comprises a first and a second spring, said first spring including movable make contacts for bridging said stationary contacts, said second spring including a break contact contacting said first spring when said movable make contacts of said first spring are open, or leaving said first spring just before said movable make contacts are closed.

4. A relay as claimed in claim 1, wherein said movable contact spring comprises generally T-shaped members, having center point portions thereof joined together by a bridge.

5. A relay as claimed in claim 1, and including studs carried on the movable contacts adjacent ends thereof.

6. A relay according to claim 1, and further including a shield box surrounding said stationary and said movable contacts, and mounted on said substrate and connected to ground.

7. A relay according to claim 6, wherein said shield box is adhesively mounted to said substrate.

8. A relay according to claim 1, wherein at least some of the contacts are folded over at their respective ends to form solder pads on the bottom of the substrate.

* * * * *

UNITED STATES PATENT AND TRADEMARK OFFICE

CERTIFICATE OF CORRECTION

PATENT NO. : 5,994,986

DATED : November 30, 1999

INVENTOR(S) : Takahashi

It is certified that error appears in the above-identified patent and that said Letters Patent are hereby corrected as shown below:

Col. 7, Line 22, insert a - -,- - (comma) after "spring" (first occurrence).
Col. 7, Line 26, insert a - -,- - (comma) after "bridge"

Signed and Sealed this

Twenty-second Day of May, 2001

*Attest:*

Nicholas P. Godici

NICHOLAS P. GODICI

*Attesting Officer*

*Acting Director of the United States Patent and Trademark Office*